US006119609A

United States Patent [19]

Kawaguchi et al.

[11] Patent Number: 6,119,609

[45] Date of Patent: Sep. 19, 2000

[54] HEADGEAR HOLDING APPARATUS AND PROCESS OF FORMING AN EMBROIDERY ON HEADGEAR

[75] Inventors: Yasuhiko Kawaguchi; Akio Takahashi, both of Gifu-ken, Japan

[73] Assignee: Brother Kogyo Kabushiki Kaisha, Nagoya, Japan

[21] Appl. No.: 09/110,257

[22] Filed: Jul. 6, 1998

[51] Int. Cl.[7] ..... D05C 9/04

[52] U.S. Cl. ..... 112/103; 112/475.11

[58] Field of Search ..... 112/103, 155, 112/470.06, 470.09, 470.14, 470.18, 102, 102.5, 63, 309, 318, 475.11

[56] References Cited

U.S. PATENT DOCUMENTS

| | | | |
|---|---|---|---|
| 5,415,116 | 5/1995 | Nishio . | |
| 5,553,560 | 9/1996 | Tajima et al. . | |
| 5,832,853 | 2/2000 | Pokrishevsky et al. | 112/475.11 |
| 6,019,053 | 2/2000 | Kawaguchi | 112/103 |

FOREIGN PATENT DOCUMENTS

| | | |
|---|---|---|
| 61-284288 | 12/1986 | Japan . |
| 8-232158 | 9/1996 | Japan . |

*Primary Examiner*—Peter Nerbun
*Attorney, Agent, or Firm*—Oliff & Berridge, PLC

[57] ABSTRACT

A headgear holding apparatus including a base structure attached to a sewing machine such that the base structure is movable in a first direction, a rotatable structure supported by the base structure such that the rotatable structure is rotatable about a first axis line parallel to the first direction, a headgear holder which has a part-cylindrical outer surface for holding an inner surface of a headgear, the holder being detachably attached to the rotatable structure such that the part-cylindrical outer surface thereof is rotated when the rotatable structure is rotated, a headgear support member which is attached to the base structure, has a curved outer surface, and extends near a sewing position where a sewing needle of the sewing machine is reciprocated, the curved outer surface supporting the inner surface of the headgear when the holder is rotated, and two or more guide rollers attached to the base structure such that the rollers are provided on both sides of the headgear support member in a second direction perpendicular to the first direction, extend parallel to the first direction, and are rotatable about respective second axis lines parallel to the first axis line, the rollers being located at respective positions where an outer circumferential surface of a contact portion of each of the rollers contacts an inner surface of an intermediate annular portion of the headgear.

18 Claims, 12 Drawing Sheets

HEADGEAR HOLDING APPARATUS AND PROCESS OF FORMING AN EMBROIDERY ON HEADGEAR

BACKGROUND OF THE INVENTION

1. Field of the Invention

The present invention relates to a headgear holding apparatus which is used with an embroidery sewing machine and which holds a headgear on which an embroidery is formed by the sewing machine.

2. Related Art Statement

There is known a multiple-head embroidery sewing machine which includes a plurality of sewing heads including respective sewing-bed arms; a worksheet feed member which is moved in an X direction perpendicular to the sewing-bed arms and is also moved in a Y direction perpendicular to the X direction, independent of the X-direction movement thereof; and a plurality of worksheet holding devices each of which is detachably attached to the worksheet feed member and holds a worksheet such that the corresponding sewing head forms an embroidery on the worksheet held thereby. The plurality of worksheet holding devices may be a plurality of headgear holding devices each of which is detachably attached to the corresponding sewing head and holds a headgear (e.g., a cap or a hat) such that the corresponding sewing head forms an embroidery on a frontal portion of the headgear held thereby.

Each of the known headgear holding devices includes a base structure which is movable in the front-rear direction (i.e., Y direction) parallel to the sewing-bed arm of the corresponding sewing head; a rotatable structure which is supported by the base structure such that the rotatable structure is rotatable about an axis line parallel to the Y direction; a headgear holder which holds a headgear on which the sewing head forms stitches and which is detachably attached to the rotatable structure; and a converting device which converts the movement of the worksheet feed member in the X direction, into the rotation of the rotatable structure. The headgear holding devices are disclosed in, e.g., Japanese Patent Document No. 8(1996)-232158. The base structure of each headgear holding device is connected to the worksheet feed member via a connecting device, so that the base structure and the rotatable structure are moved with the feed member in the Y direction.

As the headgear holder, there has been known a normal-range headgear holder which includes a main support member which is detachably attached to the rotatable structure and has a generally rectangular central opening corresponding to a frontal portion (i.e., normal-range embroidery area) of a headgear; and a press member which has a central opening corresponding to that of the support member and presses the frontal portion of the headgear against the support member such that the normal-range embroidery area of the headgear is held between the press member and the support member. After a working person sets a headgear on the support member, he or she engages two engaging members provided on opposite end portions of the press member, with two engaging hooks provided on the support member. Thus, the normal-size embroidery area of the headgear that has a length of about 10 to 12 cm and a width of about 7 cm is tightly stretched by the cooperation of the press member and the support member. The inner surface of the cloth of the frontal portion of the headgear that corresponds to the normal-range embroidery area is backed up by a backing cloth called "core cloth" sewn to the cloth to reinforce the cloth.

Recently, there has been a demand for a large embroidery pattern which is formed in a wide-range embroidery area corresponding to a frontal portion and two temporal portions of a headgear. To this end, there has been developed a wide-range headgear holder which holds only an end portion of a frontal portion of a headgear to which its brim is sewn. In this case, the rotatable structure to which the wide-range headgear holder is attached is rotated by a large angle corresponding to the wide-range embroidery area. Thus, a large embroidery pattern is formed in the frontal and temporal portions of the headgear. Though the frontal portion of the headgear is reinforced by a backing cloth sewn thereto, the entire cup portion of the headgear which is other than its brim and in which the head of a user fits is unbound, i.e., free. That is, the headgear holder does not hold the headgear such that the wide-range embroidery area corresponding to the frontal and temporal portions of the headgear keeps its original, generally part-cylindrical shape. Hence, there has been employed a headgear support member which supports an inner surface of a headgear in predetermined areas on left-hand and right-hand sides of a sewing position where a sewing needle and a loop catcher cooperate with each other to form stitches on the headgear.

However, when the wide-range headgear holder is rotated at a high speed to form stitches on the headgear, a parietal portion of the free cup portion tends to delay from the brim, and a friction resistance is produced between the cloth of the cup portion and the headgear support member. Thus, the cloth of the cup portion tends to be twisted, and wrinkles occur to the cup portion. This leads to lowering the quality of the embroidery pattern formed on the headgear.

U.S. Pat. No. 5,553,560 discloses a headgear holding device which includes a base structure including a headgear support member and a roller-support plate member supporting four first support rollers; a rotatable structure rotatably supported by the four first support rollers; and two second support rollers which are located on left-hand and right-hand sides of the headgear support member and which extend frontward over the front end of the headgear support member. The two second support rollers include respective free tapered end portions which cooperate with each other to support an inner surface of a parietal portion of a headgear held by a wide-range headgear holder attached to the rotatable structure and thereby allow a free cup portion of the headgear to be smoothly rotated. That is, when the headgear holder is rotated for embroidery stitches to be formed on the headgear, the parietal portion of the free cup portion of the headgear does not delay from the brim because the friction produced between the cup portion and the headgear support member is effectively reduced owing to the free tapered end portions of the support rollers.

However, in the headgear holding device disclosed in the above U.S. patent, the headgear support member and the two second support rollers are positioned radially inward from the locus of rotation of the headgear. If otherwise, when a normal-range headgear holder is attached to the rotatable structure in place of the wide-range headgear holder, the engaging members associated with the press member of the normal-range headgear holder interfere with the headgear support member and the second support rollers. Thus, the second support rollers cannot stretch the wide-range embroidery area corresponding to the frontal and two temporal portions of the headgear in the circumferential direction of the free cup portion of the headgear. That is, the cloth of the wide-range embroidery area cannot keep its original generally part-cylindrical shape when the headgear is rotated. Thus, wrinkles tend to occur to the cloth of the wide-range embroidery area, and the quality of the embroidery pattern formed on the headgear is not improved.

SUMMARY OF THE INVENTION

It is therefore an object of the present invention to provide a headgear holding apparatus which stretches a cloth of a wide-range embroidery area of a headgear that corresponds to a frontal portion and two temporal portions of the headgear, and which improves the quality of a large embroidery pattern formed in the wide-range embroidery area.

It is another object of the present invention to provide an embroidery forming process which stretches a cloth of a wide-range embroidery area of a headgear that corresponds to a frontal portion and two temporal portions of the headgear, and which improves the quality of a large embroidery pattern formed in the wide-range embroidery area.

The present invention provides a headgear holding apparatus and an embroidery forming process which have one or more of the technical features which are described below in respective paragraphs given parenthesized sequential numbers (1) to (18). Any technical feature which includes another technical feature shall do so by referring, at the beginning, to the parenthesized sequential number given to that technical feature. Thus, two or more of the following technical features may be combined, if appropriate. Each technical feature may be accompanied by a supplemental explanation, as needed.

(1) According to a first feature of the present invention, there is provided a headgear holding apparatus for use with an embroidery sewing machine including a machine body having a sewing-bed arm, the apparatus comprising a base structure which is adapted to be attached to the machine body such that the base structure is movable in a first direction parallel to the sewing-bed arm; a rotatable structure which is supported by the base structure such that the rotatable structure is rotatable about a first axis line parallel to the first direction; a headgear holder which has a part-cylindrical outer surface for holding an inner surface of a headgear on which an embroidery is formed by the sewing machine, the headgear holder being detachably attached to the rotatable structure, such that the part-cylindrical outer surface of the headgear holder is rotated about the first axis line when the rotatable structure is rotated; a headgear support member which is attached to the base structure, has a curved outer surface, and extends near a sewing position where a sewing needle of the sewing machine is reciprocated, the curved outer surface supporting the inner surface of the headgear held by the headgear holder when the headgear holder is rotated with the rotatable structure about the first axis line; and at least two guide rollers which are attached to the base structure such that the two guide rollers are provided on both sides of the headgear support member in a second direction perpendicular to the first direction, extend parallel to the first direction, and are rotatable about respective second axis lines parallel to the first axis line, the two guide rollers being located at respective positions where an outer circumferential surface of a contact portion of each of the two guide rollers contacts an inner surface of an intermediate annular portion of the headgear held by the headgear holder. In the present headgear holding apparatus, when the base structure is moved in the first direction, the headgear holder is simultaneously moved with the rotatable structure and, when the rotatable structure is rotated, the headgear holder is simultaneously rotated. Thus, an embroidery is formed in a predetermined embroidery area of the headgear held by the headgear holder, by the cooperation of a sewing needle and a thread-loop catcher provided in the sewing-bed arm. The number of the guide rollers may be greater than two. In the case where the embroidery area in which the embroidery is formed is a wide-range embroidery area which corresponds to a frontal portion and two temporal portions of the headgear, the headgear holder holds only an end portion of the frontal portion to which the brim is sewn to. Thus, the substantial entirety of the cup portion of the headgear in which the head of a user fits remains unbound or free. However, the headgear support member attached to the base structure supports or guides, near the sewing position, the inner surface of the intermediate annular portion of the headgear, when the headgear holder is rotated for stitches to be formed by the sewing machine. In the present apparatus, the two or more guide rollers which are rotatably attached to the base structure and extend in the first direction are additionally provided on both sides of the headgear support member in the second direction perpendicular to the first direction. The respective outer circumferential surfaces of the guide rollers contact the inner surface of the intermediate annular portion of the headgear holder. Therefore, when the headgear holder is rotated for forming an embroidery on the headgear, the cloth of the wide-range embroidery area of the headgear is kept stretched by the guide rollers. Thus, the frictional resistance produced between the cloth of the headgear and the headgear support member is effectively reduced, and the intermediate annular (or generally cylindrical) portion of the headgear is rotated in substantial synchronism with the rotation of the headgear holder. Accordingly, wrinkles are effectively prevented from occurring to the cloth of the wide-range embroidery area of the headgear.

(2) According to a second feature of the present invention which includes the first feature (1), the contact portion of the each guide roller has a diameter greater than a diameter of a main portion thereof. Since, the diameter of the contact portion is greater than that of the main portion of each guide roller, each guide roller can assuredly contact the inner surface of the intermediate annular portion of the headgear and can actively and reliably feed the annular portion. Thus, the parietal portion of the headgear that is distant from the brim portion thereof is effectively prevented from delaying from the brim portion when the headgear is rotated with the headgear holder.

(3) According to a third feature of the present invention which includes the first feature (1), the contact portion of the each guide roller is separable from a main portion thereof. The headgear holder may be selected from a wide-range headgear holder as the first headgear holder according to the sixth feature (6), and a normal-range headgear holder as the second headgear holder according to the sixth feature (6). In the case where the normal-range headgear holder is attached to the rotatable structure, the outer circumferential surface of the contact portion of each guide roller may interfere with the main support member of the normal-range headgear holder. However, in the present apparatus, the contact portion of each guide roller is separated from the main portion thereof. Thus, the normal-range headgear holder can be rotated without being interfered with by the guide rollers. Thus, the normal-range headgear holder is easily attached to the rotatable structure, in place of the wide-range headgear holder.

(4) According to a fourth feature of the present invention which includes the second feature (2), the contact portion of the each guide roller is separable from the main portion thereof. In this case, the headgear holding apparatus enjoys the above-indicated advantages with both the second and third features (2) and (3).

(5) According to a fifth feature of the present invention which includes the fourth feature (4), the headgear support member is detachable from the base structure. In the case where the normal-range headgear holder is attached to the rotatable structure, the headgear support member may be detached or removed from the base structure. Thus, the normal-range headgear holder is rotated without being interfered with by the headgear support member, and the normal-range headgear holder is easily attached to the rotatable structure, in place of the wide-range headgear holder.

(6) According to a sixth feature of the present invention which includes the fourth or fifth feature (4) or (5), the headgear holder is selectable from (a) a first headgear holder which includes a main support member having the part-cylindrical outer surface, and a hold member cooperating with the main support member to hold an end annular portion of the headgear that is adjacent to an opening of the headgear through which a head of a user fits into the intermediate annular portion thereof, thereby providing a frontal portion and two temporal portions of the intermediate annular portion as an embroidery area on which the embroidery is formed by the sewing machine; and (b) a second headgear holder which includes a main support member having a first central opening and the part-cylindrical outer surface, and a hold member having a second central opening and cooperating with the main support member to hold a frontal portion of the intermediate annular portion of the headgear as an embroidery area in which the embroidery is formed by the sewing machine.

(7) According to a seventh feature of the present invention which includes the sixth feature (6), the two guide rollers are located at the respective positions where when the first headgear holder is selected and attached to the rotatable structure, the outer circumferential surface of the contact portion of the each guide roller does not interfere with the main support member of the first headgear holder and where when the second headgear holder is selected and attached to the rotatable structure, the outer circumferential surface of the contact portion of the each guide roller interferes with the main support member of the second headgear holder and therefore the contact portion of the each guide roller is separated from the main portion thereof.

(8) According to an eighth feature of the present invention which includes any one of the fourth to seventh features (4) to (7), the contact portion of the each guide roller comprises an outer layer formed of a material selected from the group consisting of a rubber and a resin. Since the rubber or resin has a great friction factor, each guide roller can reliably feed or rotate the intermediate annular portion of the headgear in such a manner that the annular portion does not slip relative to the guide roller. Thus, the parietal portion of the headgear is effectively prevented from delaying from the brim portion of the headgear, when the headgear is rotated.

(9) According to a ninth feature of the present invention which includes any one of the fourth to seventh features (4) to (7), the contact portion of the each guide roller is substantially entirely formed of a material selected from the group consisting of a rubber and a resin. In this case, the headgear holding apparatus enjoys the same advantages as those of the eighth feature (8).

(10) According to a tenth feature of the present invention which includes any one of the first to ninth features (1) to (9), the contact portion of the each guide roller comprises an outer layer formed of a material selected from the group consisting of a rubber and a resin.

(11) According to an eleventh feature of the present invention which includes any one of the first to ninth features (1) to (9), the contact portion of the each guide roller is substantially entirely formed of a material selected from the group consisting of a rubber and a resin.

(12) According to a twelfth feature of the present invention which includes any one of the first to eleventh features (1) to (11), the headgear holding apparatus further comprises at least one drive device which rotates at least one of the two guide rollers to feed the headgear held by the headgear holder. The drive device may comprise an electric motor which is directly connected to at least one of the guide rollers to rotate the one guide roller. The electric motor may be controlled by a control device which also controls a drive device (e.g. , electric motor) which moves the base structure in the first direction, and another drive device (e.g., electric motor) which rotates the rotatable structure.

(13) According to a thirteenth feature of the present invention which includes the twelfth feature (12), each of the two guide rollers comprises, in addition to the contact portion thereof, a driven portion which is engaged with the rotatable structure, so that when the rotatable structure is rotated, the each guide roller is rotated to feed the headgear, the at least one drive device comprising the rotatable structure. For example, a first gear may be provided on the outer circumferential surface of the driven portion, and a second gear may be provided on an inner circumferential surface of the rotatable structure.

(14) According to a fourteenth feature of the present invention which includes the thirteenth feature (13), an outer circumferential surface of the driven portion of the each guide roller is held in frictional contact with an inner circumferential surface of the rotatable structure, so that when the rotatable structure is rotated, the outer circumferential surface of the contact portion of the each guide roller is moved at a speed substantially equal to a speed at which the inner surface of the intermediate annular portion of the headgear is moved by the rotation of the headgear holder and the rotatable structure, in a same direction as a direction in which the inner surface of the intermediate annular portion is moved. In the present apparatus, the guide rollers can actively rotate and feed the intermediate annular portion of the headgear, while contacting the inner surface of the annular portion. Thus, in the case where the wide-range headgear holder is selected and attached to the rotatable structure, the wide-range embroidery area of the headgear is rotated while keeping its regular part-annular or part-cylindrical shape over its entirety.

(15) According to a fifteenth feature of the present invention which includes the fourteenth feature (14), the each guide roller comprises an outer layer which is formed of a material selected from the group consisting of a rubber and a resin, is provided on the driven portion, and is held in frictional contact with the inner circumferential surface of the rotatable structure. In this case, each guide roller can be assuredly rotated in synchronism with the rotation of the rotatable structure.

(16) According to a sixteenth feature of the present invention, there is provided a process of forming, using an embroidery sewing machine including a sewing needle and a sewing-bed arm in which a thread-loop catcher is provided, an embroidery on a headgear including an intermediate annular portion and having an opening through which a head of a user fits into the intermediate annular portion, the process comprising the steps of setting, on a headgear holder, the headgear such that an end annular portion of the headgear that is adjacent to the opening thereof is held by the headgear holder, positioning the headgear holder around the sewing-bed arm of the sewing machine, such that the headgear holder is rotatable around the sewing-bed arm, causing an outer circumferential surface of a contact portion of at least one feed roller to contact an inner surface of the intermediate annular portion of the headgear held by the headgear holder, rotating the headgear holder and thereby rotating the headgear relative to the sewing needle and the sewing-bed arm, so that the embroidery is formed, by cooperation of the sewing needle and the thread-loop catcher, on an outer surface of the intermediate annular portion of the headgear held by the headgear holder, and rotating the feed roller such that the outer circumferential surface thereof is moved at a speed substantially equal to a speed at which the inner surface of the intermediate annular portion of the headgear is moved by the rotation of the headgear holder, in a same direction as a direction in which the inner surface of the intermediate annular portion is moved. According to this process, an excellent large embroidery is formed on the cloth of a wide-range embroidery area of the headgear that corresponds to a frontal portion and two temporal portions of the headgear. Thus, the quality of the embroidery formed on the headgear is improved.

(17) According to a seventeenth feature of the present invention which includes the sixteenth feature (16), the at least one feed roller is rotated in substantial synchronism with the rotation of the headgear holder.

(18) According to an eighteenth feature of the present invention which includes the sixteenth or seventeenth feature (16) or (17), the headgear is fed by at least two feed rollers which are provided on both sides of the sewing-bed arm of the sewing machine.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
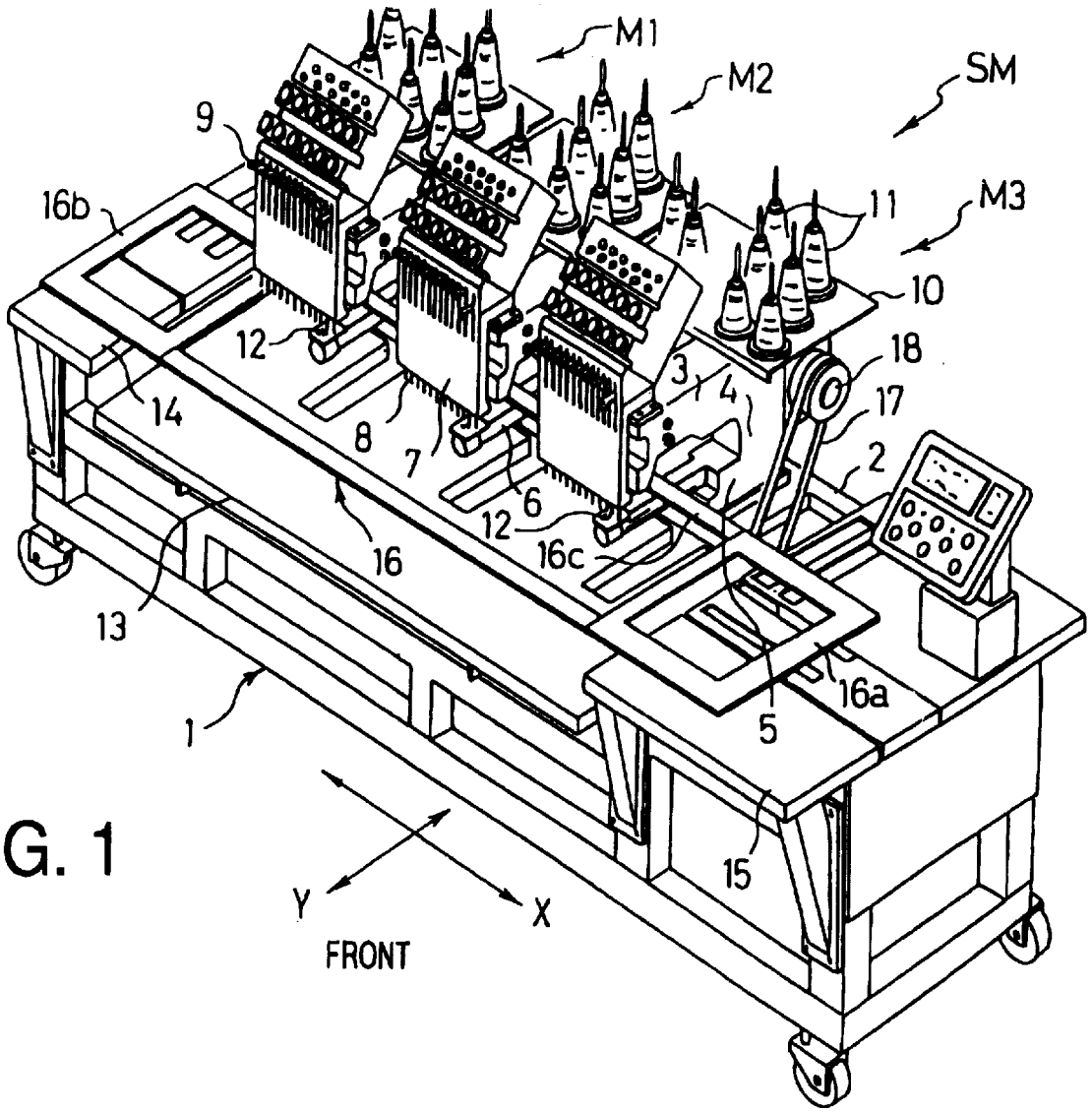
FIG. 1 is a perspective view of a multiple-head embroidery sewing machine to which a headgear holding apparatus according to the present invention is detachably attached.

In FIG. 1, there is shown a multiple-head embroidery sewing machine, SM, which includes three multiple-needle sewing heads, M1, M2, M3, each of which has an identical construction. Each sewing head M1–M3 can be used with a headgear holding apparatus 20 (FIG. 2) in accordance with the present invention, to form embroidery stitches on a headgear held by the holding apparatus 20. Thus, the sewing machine SM can simultaneously form three embroideries on three headgears held by the three holding apparatuses 20, respectively.

Figure 2:
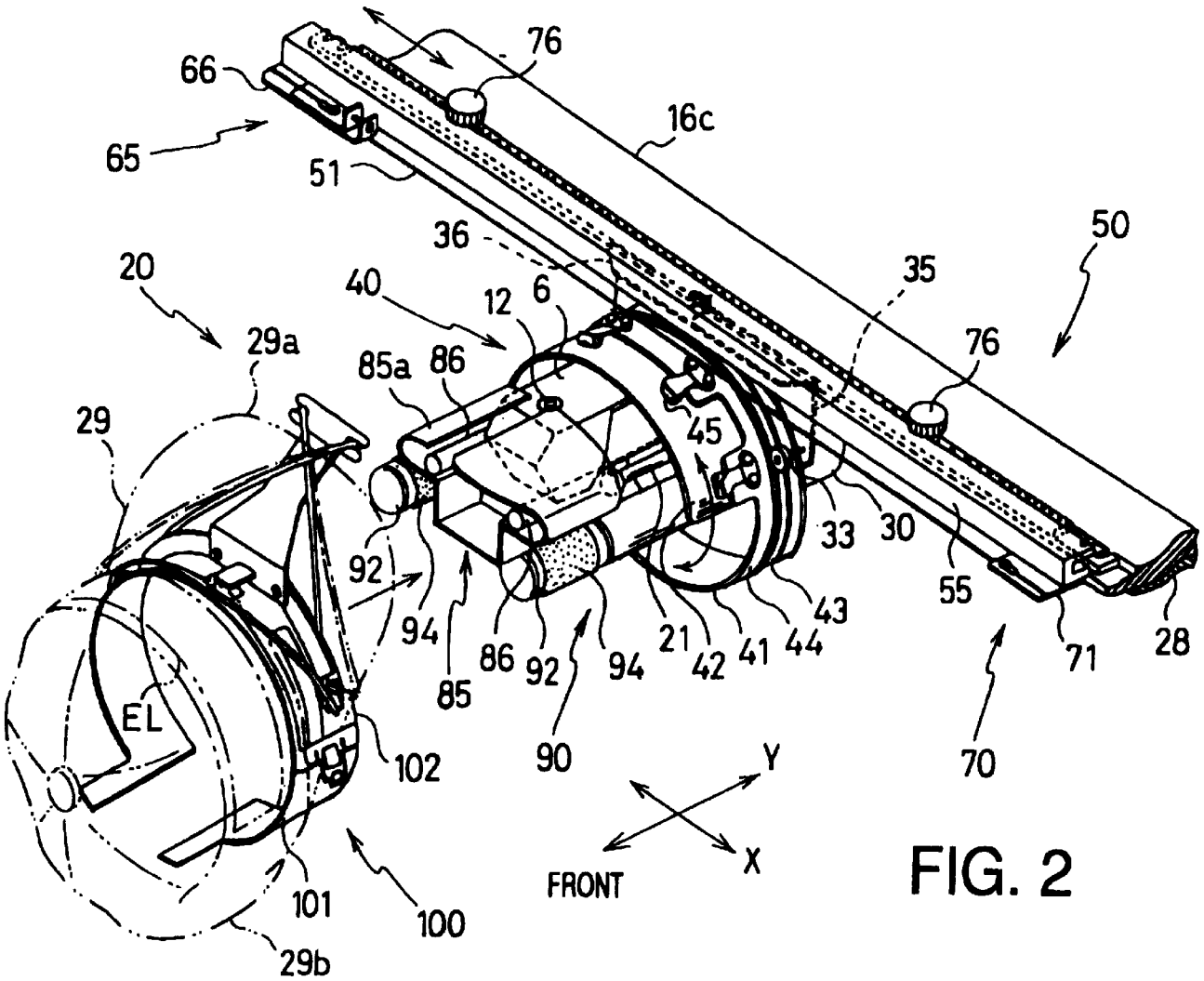
FIG. 2 is a perspective view of the headgear holding apparatus according to the present invention, showing a wide-range headgear holder thereof detached from a rotatable structure thereof.
Figure 3:
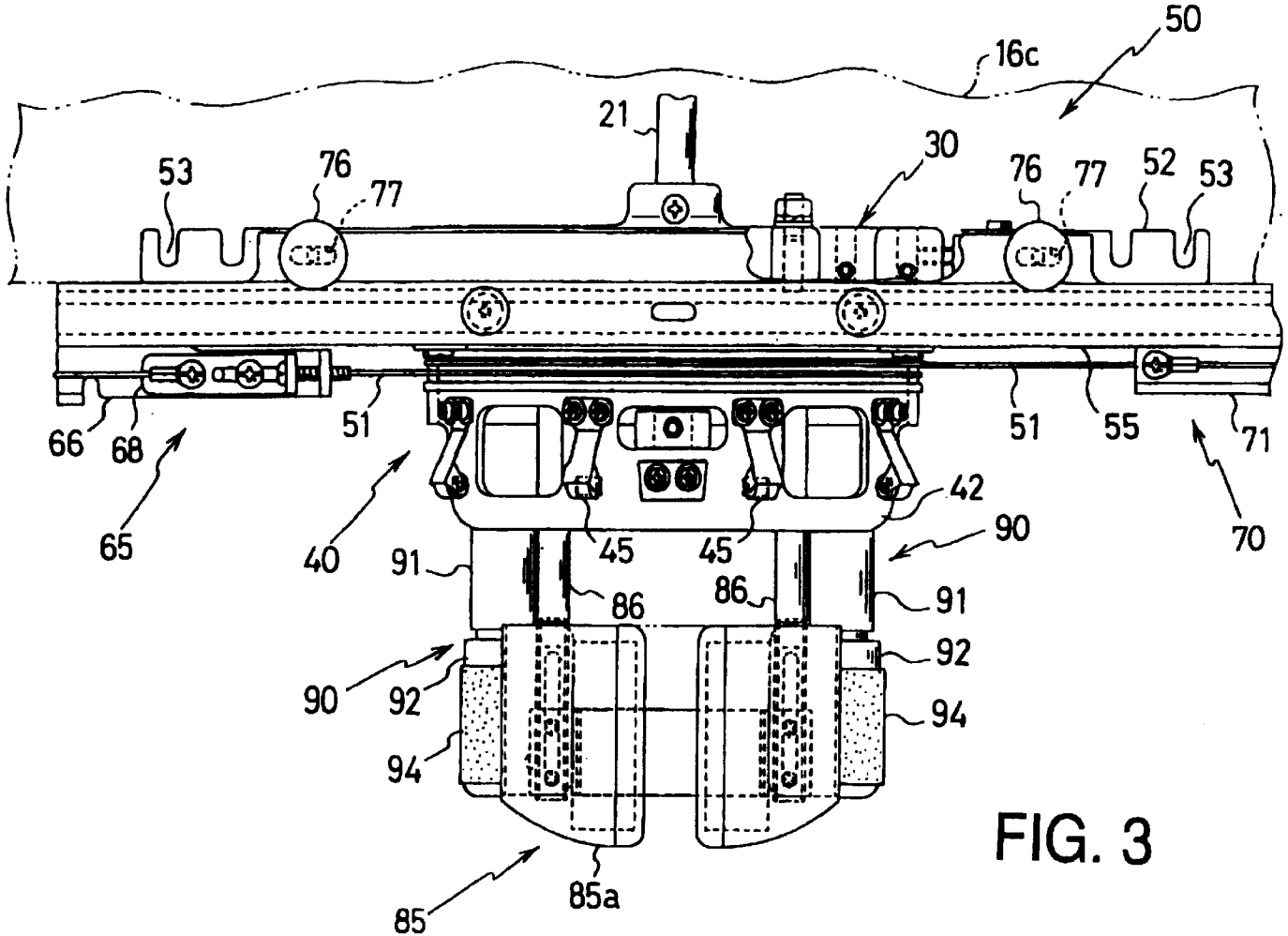
FIG. 3 is a plan view of the headgear holding apparatus of FIG. 2, with the wide-range headgear holder being detached therefrom.

As shown in FIG. 1, the sewing machine SM includes a machine table 1 which is long in an X direction and short in a Y direction perpendicular to the X direction (the X and Y directions are indicated at arrows in FIGS. 1 and 2). On a rear end portion of the machine table 1, there is provided a base plate 2 which has a generally rectangular shape long in the X direction. On the base plate 2, the three sewing heads M1–M3 are arranged in an array in the X direction.

Each sewing head M1–M3 includes a sewing-head arm 3 which supports, at a front end thereof, a needle-bar housing 7 which accommodates twelve needle bars (not shown) arranged in an array in the X direction and twelve thread take-up levers 9 associated with the respective needle bars. The needle-bar housing 7 is movable, on the sewing-head arm 3, horizontally in the X direction, so that one of the twelve needle bars may be selected and brought into a sewing position where the selected needle bar is vertically reciprocated and the thread take-up lever 9 associated therewith is vertically swung, each in synchronism with the rotation of an upper drive shaft (not shown) extending in the sewing-head arm 3. The sewing position is aligned with a needle throat 12 formed in a front end portion of a sewing-bed arm 6 which has a generally cylindrical shape.

The sewing-head arm 3 of each sewing head M1–M3 extends, like a cantilever, horizontally from an upper end portion of an arm support 4 which extends vertically upward from a machine body or head base 5. The head base 5 is fixed to a top surface of the base plate 2. The sewing-bed arm 6 extends from a front face of the head base 5, and accommodates, in the front end portion thereof, a thread-loop catcher (not shown) which catches a loop of an embroidery thread conveyed by a sewing needle 8 secured to a lower end of a selected needle bar which is currently indexed at the sewing position of each sewing head M1–M3. The loop catcher is rotated by a lower drive shaft (not shown) extending in the sewing-bed arm 6.

As shown in FIG. 1, twelve sewing needles 8 are secured to the twelve needle bars of each sewing head M1–M3, respectively, and are supplied with twelve color-different embroidery threads from twelve spools 11 of a spool holder 10, respectively. A desired one of the twelve color threads is selected by moving the corresponding needle bar and needle 8 to the sewing position, and stitches are formed with the selected color thread by cooperation of the selected needle 8 and the loop catcher provided in the sewing-bed arm 6. The above-mentioned upper and lower drive shafts are operatively connected to a common drive shaft 18, which is connected via a V belt 17 to a main drive motor (not shown) and is rotated by the main motor. The needle-bar housing 7 of each sewing head M1–M3 is moved by an exclusive drive motor (not shown).

In front of the base plate 2, there is provided a working table 13 which is movable upward and downward. On right and left sides of the working table 13, there are provided two side tables 14, 15, respectively. When the working table 13 is moved up to its uppermost position, the upper surface of the working table 13 becomes flush with the respective upper surfaces of the two side tables 14, 15 and the respective upper surfaces of the three sewing-bed arms 6. A worksheet feed frame 16 having a generally rectangular shape long in the X direction includes a right frame portion 16*a* and a left frame portion 16*b* which are provided on, and supported by, the right and left side tables 14, 15, respectively. The right frame portion 16*a* is driven or moved in the X direction by an X-direction feeding device. A Y-direction feed member 28 (FIGS. 2 and 5) is provided under, and engaged with, a rear frame portion 16*c* of the feed frame 16, and is driven or moved only in the Y direction by a Y-direction feeding device, so that the feed frame 16 engaged with the Y-direction feed member 28 is moved in the Y direction. Thus, the feed frame 16 is movable above or on the tables 13–15 by the X-direction and Y-direction feeding devices in the horizontal plane defined by the X and Y directions.

As shown in FIGS. 2 to 5, the headgear holding apparatus 20 includes (a) a cylindrical guide bar 21 which extends in the Y direction in the state in which the guide bar 21 is attached to the head base 5 of each sewing head M1–M3; (b) a base structure 30 which is supported by the guide bar 21 such that the base structure 30 is movable in the Y direction by being guided by the guide bar 21; (c) an inhibit mechanism 24 which inhibits the base structure 30 from rotating about the guide bar 21; (d) a rotatable structure 40 which is supported by the base structure 30 such that the rotatable structure 40 is rotatable about an axis line parallel to the Y direction (i.e., parallel to the guide bar 21) and such that the rotatable structure 40 is movable together with the base structure 30 relative to the head base 5 in the Y direction; (e) a wide-range headgear holder 100 (FIG. 2) or a normal-range headgear holder 110 (FIG. 10) which is detachably attached to the rotatable structure 40 and which holds a headgear such as a cap or hat on which embroidery stitches are formed by each sewing head M1–M3; (f) a converting mechanism 50 which converts the X-direction movement of the feed frame 16 into the rotation of the rotatable structure 40 and the headgear holder 110 or 110 about the above-mentioned axis line; and (g) a connecting device 80 which operatively connects the base structure 30 to the Y-direction feed member 28 which is engaged with the lower surface of the rear frame portion 16*c* of the feed frame 16 and accordingly is moved together with the feed frame 16 in the Y direction by the Y-direction feeding device. The Y-direction feed member 28, however, cannot be moved in the X direction even when the feed frame 16 is moved in the X direction by the X-direction feeding device. In addition, the headgear holding apparatus 20 includes (h) a headgear support plate 85 and a pair of headgear guide rollers 90 all of which are fixed to a vertical connection plate 35 which is attached to the base structure 30.

Each of the above-indicated elements (a) to (h) will be described below in more detail.

Figure 5:
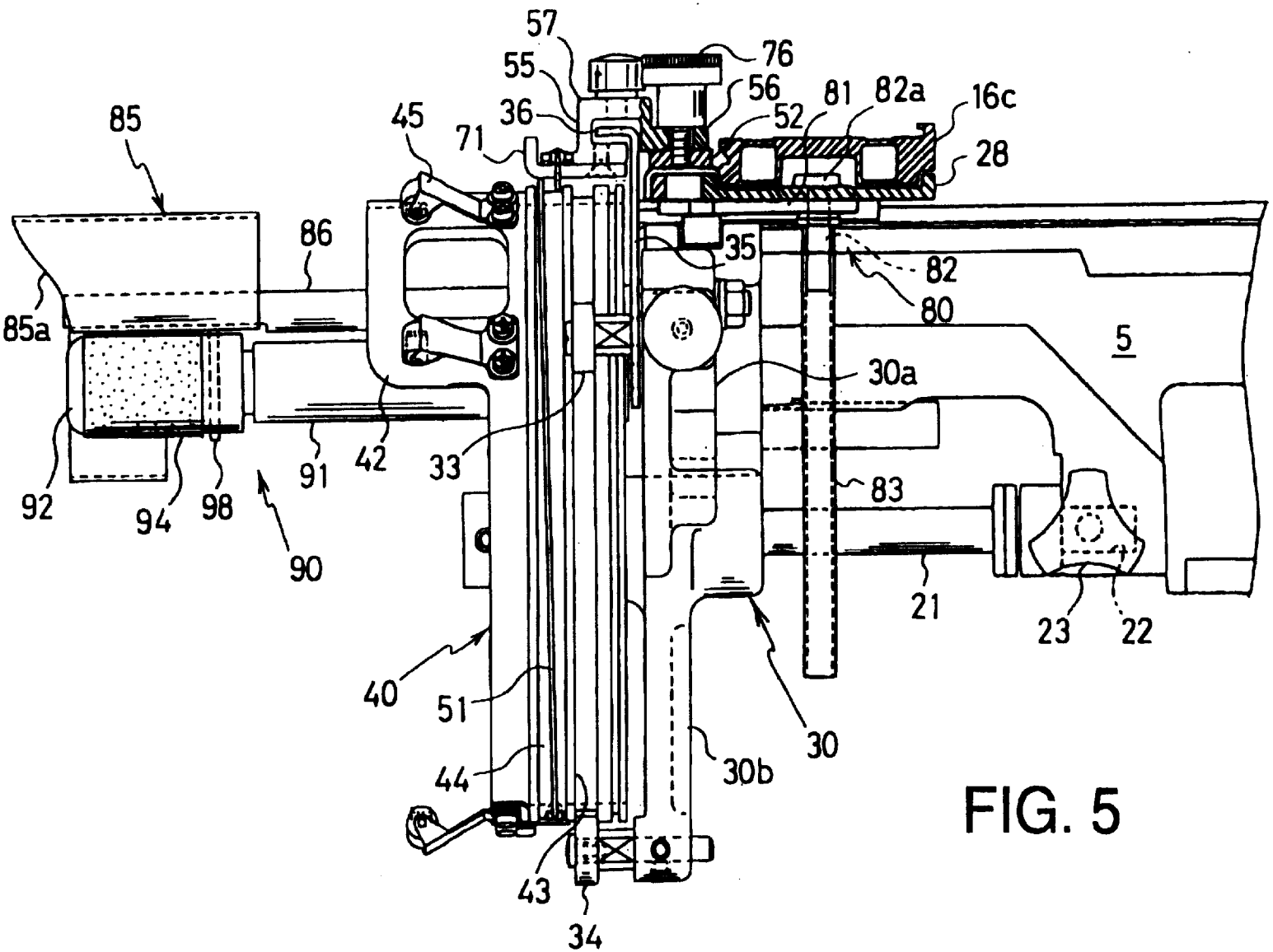
FIG. 5 is a side elevation view of the headgear holding apparatus of FIG. 2, with the wide-range headgear holder being detached therefrom.

As shown in FIG. 5, the element (a), i.e., the guide bar 21 is detachably attached to the front face of the machine body or head base 5 of each sewing head M1–M3, in such a manner that the guide bar 21 is inserted rearward into an insertion hole 22 which is formed in the head base 5 to extend horizontally in the Y direction. The guide bar 21 inserted in the insertion hole 22 is fastened by a fastening member 23 such as a screw having a knob. Thus, the guide bar 21 is detachably attached to the head base 5 of the sewing head M1–M3.

Figure 4:
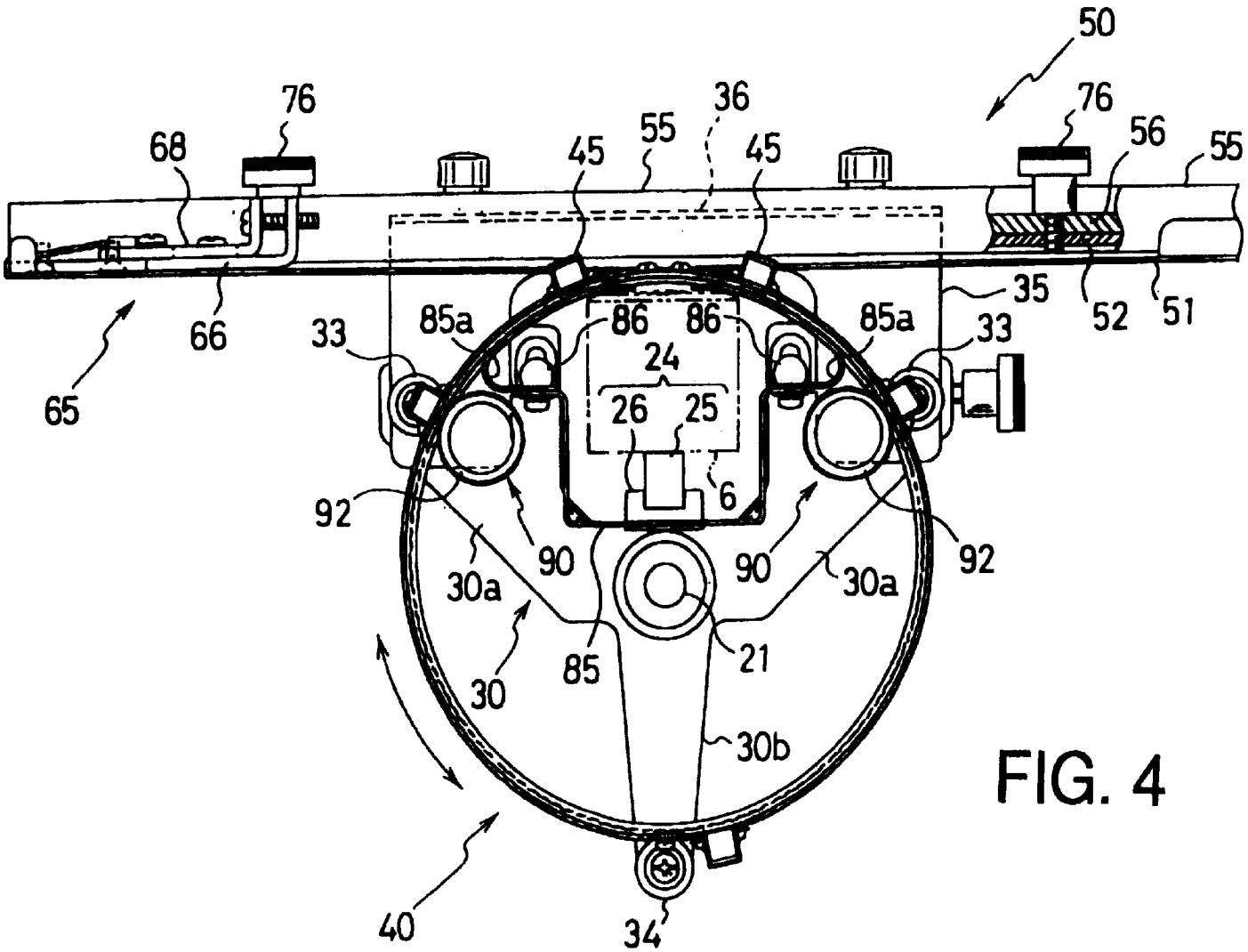
FIG. 4 is a front elevation view of the headgear holding apparatus of FIG. 2, with the wide-range headgear holder being detached therefrom.

As shown in FIG. 4, the element (b), i.e., the base structure 30 includes a fitting sleeve which is externally fitable on the cylindrical guide bar 21 such that the base structure 30 is slideable or movable on the guide bar 21 in the Y direction. The base structure 30 has a generally Y-shaped configuration including two upper arm portions 30*a* and one lower arm portion 30*b* all of which extend radially outward from the fitting sleeve. Each of the two upper arm portions 30*a* supports, at a free end thereof, a support roller 33 which externally supports the rotatable structure 40. That is, the two support rollers 33 of the base structure 30 cooperate with a third support roller 34 (FIG. 4) to support the rotatable structure 40 such that the structure 40 is rotatable about an axis line parallel to the Y direction. Each of the support rollers 33 can be moved by an eccentricity-utilizing adjusting mechanism (not shown) so that the horizontal axis line about which the rotatable structure 40 is rotatable may be moved or adjusted in a radial direction thereof.

As shown in FIG. 4, the element (c), i.e., the inhibit mechanism 24 includes a key member 25 which is fixed to a lower face of the sewing-bed arm 6 and extends in the Y direction. The inhibit mechanism 24 further includes a grooved member 26 which is fixed to an upper face of the base structure 20 and has a groove which is engaged with the key member 25 when the guide bar 21 and the base structure 30 are attached to the head base 5. The grooved member 26 engaged with the key member 25 is slideable or movable relative to the key member 25, so that the engaged key and grooved members 25, 26 permit the base structure 30 to be guided and moved on the guide bar 21 in only the Y direction but do not permit the same 30 to rotate about the guide bar 21 extending in the Y direction. However, the key member 25 may be fixed to the base structure 30, and the grooved member 26 may be fixed to the sewing-bed arm 6.

As shown in FIG. 2, the element (d), i.e., the rotatable structure 40 includes an annular portion 41 which has a circular cross section, and a headgear-holder support portion 42 which extends frontward over a predetermined length from an upper half of the annular portion 41 and which has a semi-circular cross section. The annular portion 41 has, in an outer circumferential surface thereof, a roller guide groove 43 in which the three support rollers 33, 34 fit and roll, and a wire guide groove 44 in which two connection wires 51 of the converting mechanism 50 run. A lower end portion of the annular portion 41 is guided by the third guide roller 34 supported by the lower arm portion 30*b* of the base structure 30. Five engaging rollers 45 are attached to the outer surface of the annular portion 41 via respective spring members as biasing members. The headgear holder 110 or 110 is detachably attached to the rotatable structure 40 such that an arcuate fitting portion of the holder 110 or 110 externally fits on the headgear-holder support portion 42 of the structure 40 against the elastic biasing forces of the spring members associated with the engaging rollers 45. Thus, the engaging rollers 45 are brought into engagement with engaging holes (not shown) of the fitting portion of the holder 110 or 110.

The element (e), i.e., the headgear holder 110 or 110 will be described later.

As shown in FIGS. 2 to 5, the element (f), i.e. the converting mechanism 50 includes the two connection wires 51 which are wound around the rotatable structure 40; a first conversion member 52 which is elongate in the X direction and is detachably attached to the rear frame portion 16*c* of the worksheet feed frame 16; and a second conversion member 55 which is elongate in the X direction, includes two opposite end portions providing two wire connection portions 65, 70, and is movable relative to the base structure 30 in the X direction. Respective one end portions of the two wires 51 are connected to the two wire connection portions 65, 70, respectively. The respective other end portions of the two wires 51 are fixed to the rotatable structure 40.

Each of opposite end portions of the first conversion member 52 as seen in the X direction has two recesses 53. In the state in which a lower surface of the first conversion member 52 is held in contact with the rear frame portion 16*c*, four screws each with a knob are screwed into the rear frame portion 16*c* through the four recesses 53 of the first conversion member 52. Thus, the first conversion member 52 is detachably attached to the worksheet feed frame 16.

As shown in FIG. 5, the second conversion member 55 includes a horizontal plate-like portion 56 which is placed on the first conversion member 52 and is fixed to the same 52, and a front engaging portion 57 which is formed integrally with the horizontal portion 56 in front of the same 56, and has a generally U-shaped cross section, and with which an upper bent portion 36 of the connection plate 35 fixed to the base structure 30 is engaged.

The plate-like portion 56 has two elongate holes 77. Two screws 76 each with a knob are screwed into the first conversion member 52 through the elongate holes 77 of the plate-like portion 56. Thus, the second conversion member 55 is detachably attached to the first conversion member 52. Therefore, when the first conversion member 52 is moved together with the worksheet feed frame 16 in the X direction, the second conversion member 55 is simultaneously moved in the X direction. Meanwhile, in the state in which the screws (not shown) are unfastened and removed from the rear frame portion 16*c*, the first and second conversion members 52, 55 and the base structure 30 can be removed as a unit, because the upper bent portion 36 of the connection plate 35 fixed to the base structure 30 is engaged with the front engaging portion 57 of the second member 55 and the first and second members 52, 55 are fixed to each other with the screws 76. Thus, the first and second members 52, 55, the wires 51, and the base structure 30 can be stably kept as a unit.

A horizontal connection plate 66 is fixed to a lower surface of the left wire connection portion 65 of the second conversion member 55, such that the connection plate 65 projects frontward. A connection member 68 is attached to an upper surface of the connection plate 66, such that the position of the connection member 68 in the X direction is adjustable. One of the two connection wires 51 that runs leftward from the rotatable structure 40 is bent first upward and then rightward at one end of the connection plate 66, so that one end portion of the one wire S1 is fixed to the connection member 68.

On the other hand, another horizontal connection plate 71 is fixed to a lower surface of the right wire connection portion 70 of the second conversion member 55, such that the connection plate 71 projects frontward. The other connection wire 51 which runs rightward from the rotatable structure 40 is bent first upward and then leftward at one end of the connection plate 71, so that one end portion of the other wire 51 is fixed to the connection member 71.

When the worksheet feed frame 16 is moved leftward in the X direction by the X-direction feeding device, the Y-direction feed member 28 is not moved in the Y direction, but the rotatable structure 40 is rotated about the center line of the annular portion 41 thereof, counterclockwise in FIG. 4. On the other hand, the rotatable structure 40 is rotated clockwise when the feed frame 16 is moved rightward in the X direction. The rotation amount of the rotatable structure 40 is directly proportional to the amount of the rightward or leftward movement of the feed frame 16 in the X direction.

As shown in FIG. 5, the element (g), i.e., the connecting device 80 includes a horizontal connecting member 81; a clamping member 82 which has a head 82*a* and is supported by one end portion of the connecting member 81 such that the clamping member 82 is movable relative to the connecting member 81 in a vertical direction, i.e., an axial direction of the clamping member 82; and a hand lever 83 whose upper end portion is connected to the clamping member 82 such that the hand lever 83 is pivotable relative to the clamping member 82. The connecting member 81 supports a slide 81*a* at the other end portion thereof. The slide 81*a* is engageable with a groove which is formed in the base structure 30 and extends in the X direction. In the state in which the head 82*a* of the clamping member 82 is engaged with an engaging hole (not shown) of the Y-direction feed member 28, an operator pivots the hand lever 83 relative to the clamping member 82, so that the head 82*a* of the clamping member 82 is moved down on the upper surface of the feed member 28 and the connecting member 81 is clamped to the feeding member 28. That is, the connecting device 80 connects the base structure 30 to the feeding member 28 via the connecting member 81 including the slide 81*a*. Therefore, when the feed member 28 is moved frontward and rearward in the Y direction by the Y-direction feeding device, the base structure 30 is also moved frontward and rearward in the Y direction.

In front of the headgear-holder support portion 42 of the rotatable structure 40, there is provided the headgear support member 85 which includes two part-cylindrical guide portions 85*a* each of which has a radius of curvature substantially equal to that of the support portion 42. The headgear support member 85 is detachably attached to two support bars 86 which are provided on a left-hand side and a right-hand side of the sewing-bed arm 6, respectively, and which extend in the Y direction. Respective rear end portions of the support bars 86 are fixed to the connection plate 35. In the state in which the headgear holder 100 or 110 which holds a cap 29 as a headgear is attached to the rotatable structure 40, the guide portions 85*a* can guide a cup portion 29*b* of the cap 29 that projects frontward in front of the rotatable structure 40, and allow the cup portion 29*b* to be rotated with the headgear holder 100 or 110 and the rotatable structure 40. The two guide portions 85*a* are provided on a left-hand side and a right-hand side of the needle throat 12 (i.e., the sewing position), respectively. The two guide portions 85*a* are positioned radially inward by several millimeters from the locus of rotation of the cup portion 29*b* of the cap 29. However, in the case where the normal-range headgear holder 110 is attached to the rotatable structure 40 and is rotated with the same 40, the headgear holder 110 interferes with the guide portions 85*a* of the support member 85. In that case, therefore, the support member 85 is detached from the support bars 86.

Figure 6:
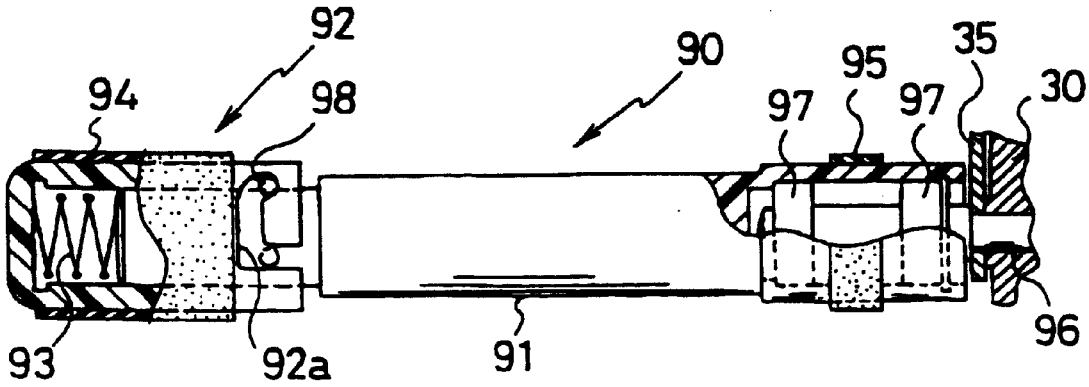
FIG. 6 is an enlarged, partly cut away, side elevation view of a guide roller of the headgear holding apparatus of FIG. 2.

The left-hand and right-hand guide rollers 90 which correspond to the two support rollers 33, respectively, are provided on a left-hand side and a right-hand side of the guide portions 85*a* of the support member 85, respectively, such that the guide rollers 90 extend in the Y direction. Each of the guide rollers 90 is formed of a synthetic resin, and is attached at a rear end portion thereof to the connection plate 35 such that the each guide roller 90 is rotatable about an axis line parallel to the Y direction. The two guide rollers 90 have an identical construction as shown in FIG. 6. A stepped bolt 96 is screwed into the connection plate 35 and the base structure 30, and a pair of bearings 97 are fitted on the stepped bolt 96. The rear end portion of each guide roller 90 is externally press-fitted on the bearings 97. Thus, each guide roller 90 is rotatably supported by the connection plate 35.

Figure 7:
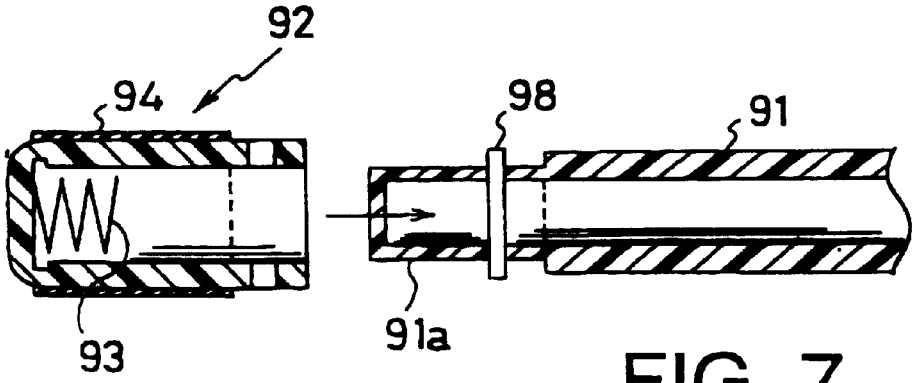
FIG. 7 is a longitudinal cross-section view of the guide roller of FIG. 6.

As shown in FIGS. 6 and 7, each guide roller 90 includes a base portion 91 as a main portion thereof, and a separable roller 92 which corresponds to a free end portion of the each guide roller 90, has a predetermined length, and is separable from the base portion 91. The separable roller 92 has a diameter greater (e.g., 25 mm) than that (e.g., 20 mm) of the base portion 91. The base portion 91 has an end portion 91*a* which has a predetermined length and has a diameter smaller than that of a remaining portion of the base portion 91. A straight pin 98 is fixed to the end portion 91*a* such that the pin 90 extends diametrically through a base portion of the end portion 91. Each guide roller 90 is positioned such that an outer circumferential surface of the separable roller 92 contacts an inner surface of the cup portion 29*b* of the cap 29 held by the headgear holder 100 or 110.

Each separable roller 92 has a cap-like shape having an inner hollow space. A coil spring 93 is provided in the inner space of the separable roller 92 such that one end of the coil spring 93 is fixed to the bottom of the roller 92. The separable roller 92 has, in the vicinity of an opening thereof, a pair of engageable holes 92*a* which are diametrically opposite to each other and each of which has a generally J shape in its plan view. The two engageable holes 91*a* are engageable with opposite end portions of the straight pin 98.

Each separable roller 92 is attached to the corresponding base portion 91, by fitting the opening of the separable roller 92 on the free end portion 91*a* of the base portion 91 in the state in which respective openings of the two engageable holes 92 are aligned with the opposite end portions of the straight pin 98, respectively, then pushing the roller 92 against the biasing force of the coil spring 93, and rotating the roller 92 clockwise. Meanwhile, the separable roller 92 is separated or detached from the base portion 91, by pushing the roller 92 against the biasing force of the coil spring 93 and rotating the roller 92 counter clockwise.

Each separable roller 92 has a rubber layer 94 as a frictional layer that defines the outer circumferential surface of the roller 92. The rubber layer 94 has a great friction factor. Therefore, the rubber layer 94 of the separable roller 92 contacts the inner surface of the cup portion 29*b* of the cap 29 which is different from a brim portion 29*a* thereof and in which the head of a user fits.

As shown in FIG. 6, each base portion 91 has a rubber layer 95 provided on a rear end portion thereof. The rubber layer 95 has a great friction factor, too. The rubber layer 95 of the base portion 91 is held in frictional contact with an inner circumferential surface of the cylindrical rotatable structure 40. Therefore, when the rotatable structure 40 is rotated, the two guide rollers 90 are driven or rotated because of friction forces produced between the respective rubber layers 95 and the inner surface of the structure 40.

Next, the wide-range headgear holder 100 and the normal-range headgear holder 110 will be described. The normal-range headgear holder 110 is used for forming, on a frontal portion of the cup portion 29*b* of the cap 29, a normal-size embroidery pattern in a standard or medium embroidery area, EM (FIG. 10), having the width of about 7 cm and the length of about 10 to 12 cm. The wide-range headgear holder 100 is used for forming, on the frontal portion and two temporal portions of the cup portion 29*b*, a large-size embroidery pattern in a large embroidery area, EL (FIG. 2), having the width of about 7 cm and the length of about 14 to 15 cm.

Figure 9:
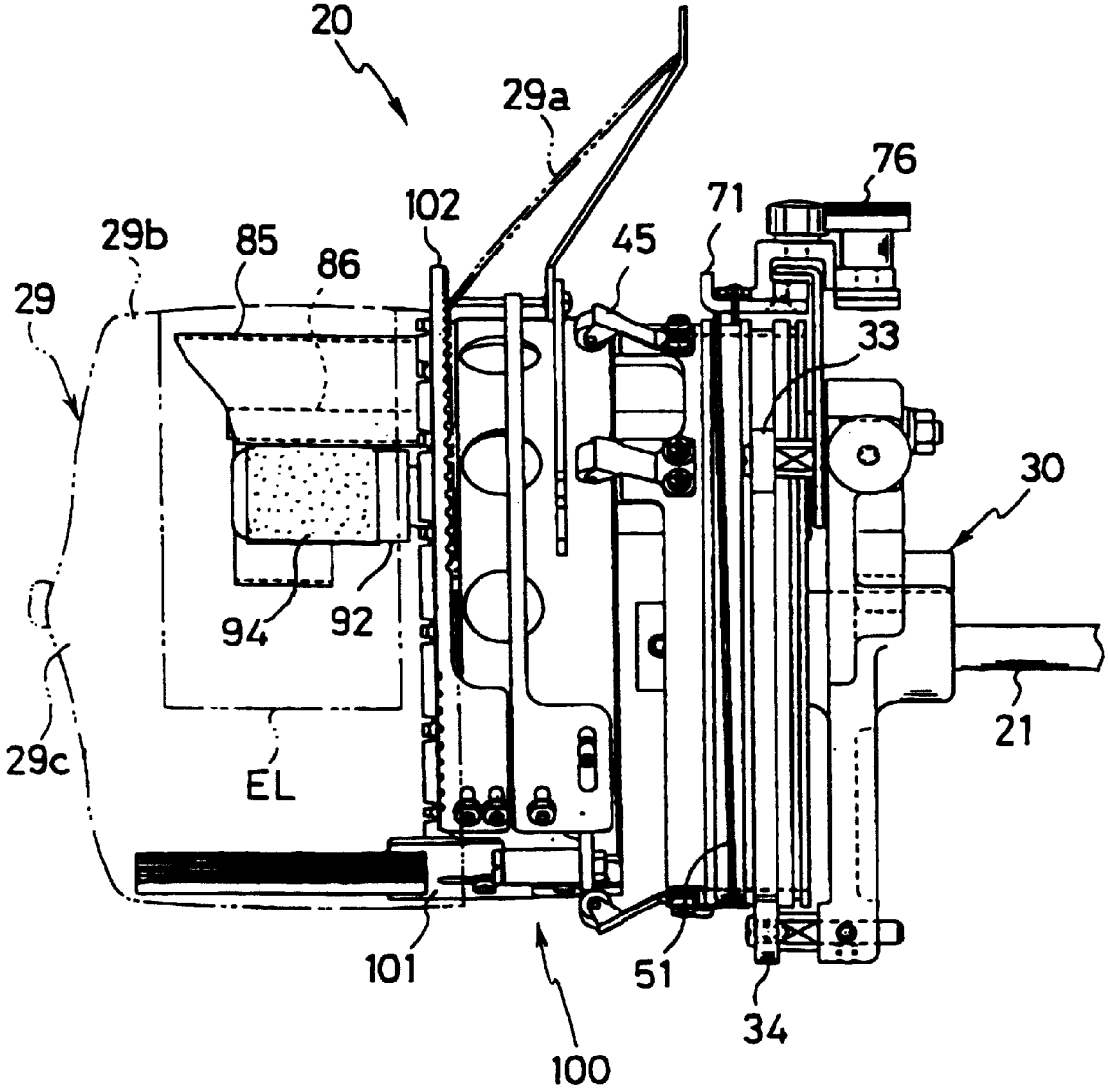
FIG. 9 is a view corresponding to FIG. 5, showing the headgear holding apparatus of FIG. 2, with the wide-range headgear holder being attached thereto.

First, the wide-range headgear holder 100 will be described. As shown in FIGS. 2 and 9, the headgear holder 100 includes a main support member 101 which has a part-cylindrical shape having a radius of curvature corresponding to that of the headgear-holder support portion 42 of the rotatable structure 40 and which is detachably attached to the support portion 42; and a press member 102 which is detachably attached to the main support member 101 to press externally the cap 29 against the same 101 and thereby hold the cap 29.

Figure 8:
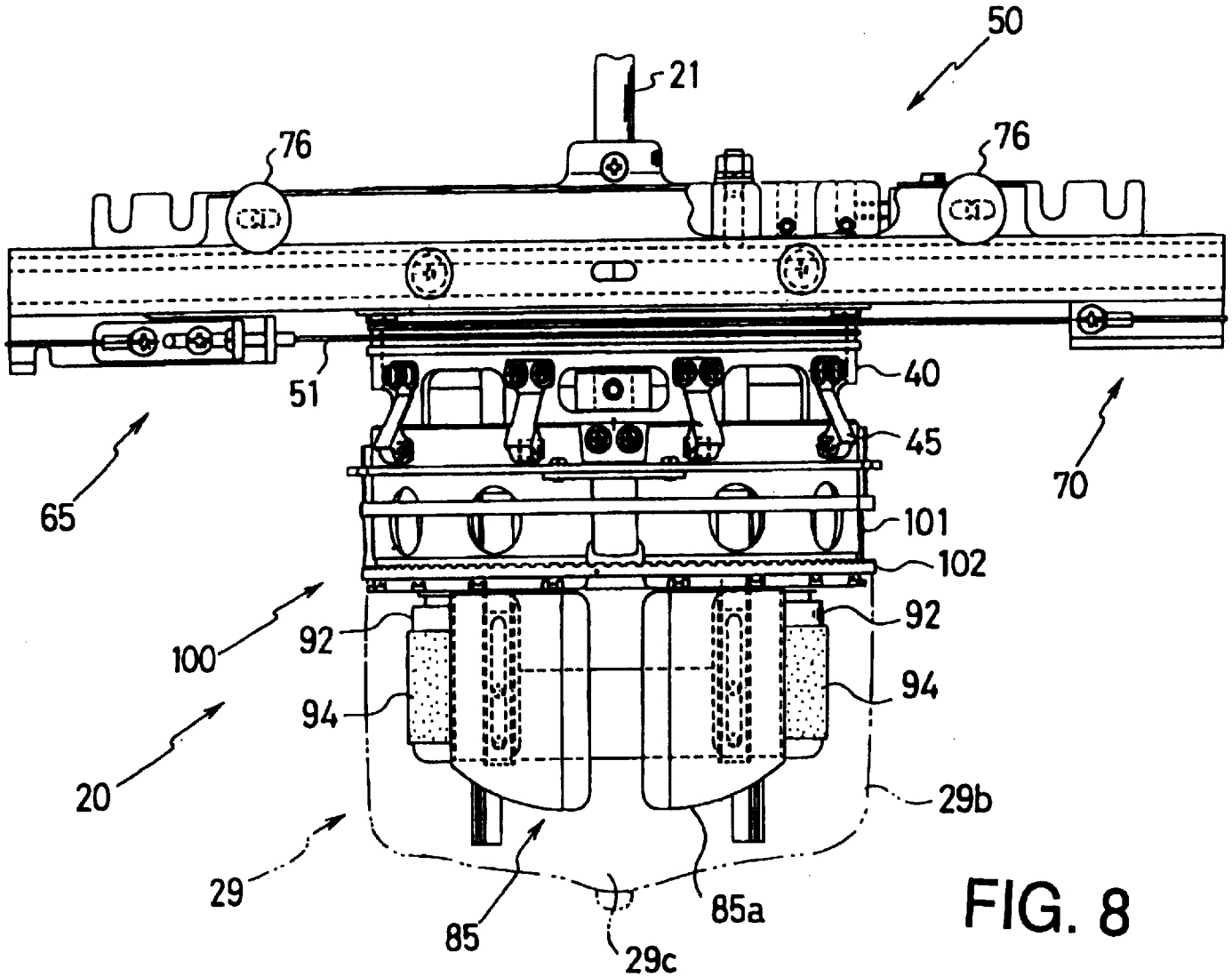
FIG. 8 is a view corresponding to FIG. 3, showing the headgear holding apparatus of FIG. 2, with the wide-range headgear holder being attached thereto.

The cap 29 is set on the headgear holder 100 at a preparation station (not shown). More specifically described, as shown in FIG. 2, only an end annular portion of the cup portion 29*b* that corresponds to a sweatband (not shown) of the cap 29 is externally fitted on the main support member 101, and only a front portion of the end annular portion to which the brim portion 29*a* is sewn is externally pressed by the press member 102. Subsequently, one of opposite end portions of the press member 102 is clamped to the main support member 101 using a clamping device (not shown). The other end portion of the press member is connected to the main support member 101 via hinges. Then, as shown in FIGS. 8 and 9, the headgear holder 100 holding the cap 29 is attached to the rotatable structure 40. Thus, almost the entire cup portion 29*b* of the cap 29 remains unbound, i.e., free.

Next, there will be described the operation of the headgear holding apparatus 20 constructed as described above.

In the case where the wide-range headgear holder 100 is attached to the rotatable structure 40, the headgear holder 100 holds the cap 29 such that only the front portion of the end annular portion of the cup portion 29 to which the brim 29*a* is sewn is sandwiched by the main support member 101 and the press member 102, as shown in FIGS. 8 and 9. Therefore, almost the entire cup portion 29*b* remains free. However, the two part-cylindrical guide portions 85*a* of the headgear support member 85 attached to the connection plate 35 cooperate with each other to guide the free cup portion 29*b* in two predetermined areas on the left-hand and right-hand sides of the needle throat 12 of the sewing-bed arm 6. In addition, the respective separable portions 92 of the two headgear guide rollers 90 provided on the left-hand and right-hand sides of the support member 85 are held in contact with the inner surface of the intermediate annular portion of the free cup portion 29*b*.

The two guide rollers 90 cooperate with each other to stretch out the cloth of the large embroidery area EL of the free cup portion 29*b*, and prevent wrinkles from occurring to the cloth, when the cap 29 is rotated with the headgear holder 100 and the rotatable structure 40. An embroidering operation is carried out by moving the worksheet feed frame 16 in the X and Y directions. In particular, when the feed frame 16 is moved in the X direction, the second conversion member 55 is moved in the X direction and simultaneously the rotatable structure 40 and the headgear holder 100 are rotated as a unit clockwise and counterclockwise via the two wire connection portions 65, 70 and the two connection wires 51.

When the cap 29 is rotated with the wide-range headgear holder 100 and the rotatable structure 40, the two guide portions 85*a* of the headgear support member 85 guide the inner surface of the intermediate annular portion of the cap 29 in the two predetermined areas on the right-hand and left-hand sides of the needle throat 12 of the sewing-bed arm 6, while the guide portions 85*a* permit the cap 29 to slide thereon relative thereto. In addition, the two headgear guide rollers 90 which are held in frictional contact with the inner cylindrical surface of the rotatable structure 40, are rotated in synchronism with the rotation of the same 40, so that the cup portion 29*b* is actively fed because of the friction forces produced between the rubber layers 94 and the inner surface of the cup portion 29*b*. Thus, the cloth of the large embroidery area EL is prevented from being pressed on the guide portions 85*a* of the support member 85, and accordingly the frictional resistance applied to the support member 85 is reduced. Since the cup portion 29*b* of the cap 29 is rotated in substantial synchronism with the wide-range headgear holder 100, an excellent embroidery pattern is formed in the large embroidery area EL of the cap 29, while wrinkles are prevented from occurring to the area EL.

When a sewing operation is carried out by rotating the cap 29, a parietal portion 29*c* of the cup portion 29*b* that is distant from the brim portion 29*a* tends to delay from the rotation of the brim portion 29*a*. However, the two guide rollers 90 include the respective separable rollers 92 whose diameter is greater than that of the base portions 91 thereof, and the two separate rollers 92 have the respective rubber layers 94 which have a great friction factor. Accordingly, the cloth of the parietal portion 29*c* is actively rotated when the frontal and temporal portions of the intermediate annular portion of the cup portion 29*b* are rotated by the separable rollers 92. Thus, the entire cup portion 29*b* is smoothly rotated relative to the headgear support member 85.

Figure 10:
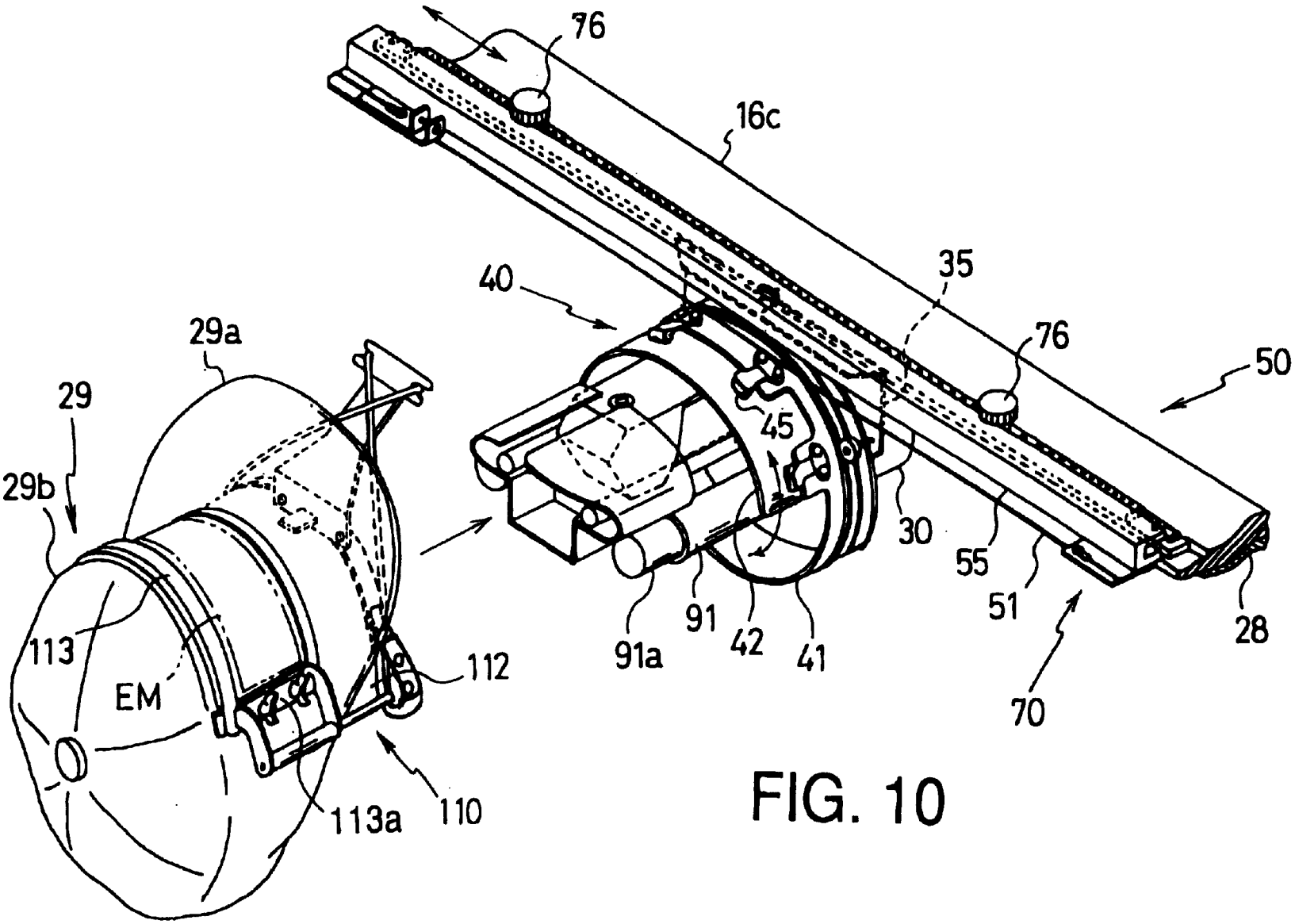
FIG. 10 is a view corresponding to FIG. 2, showing the headgear holding apparatus of FIG. 2, and a normal-range headgear holder thereof detached from the rotatable structure thereof.
Figure 11:
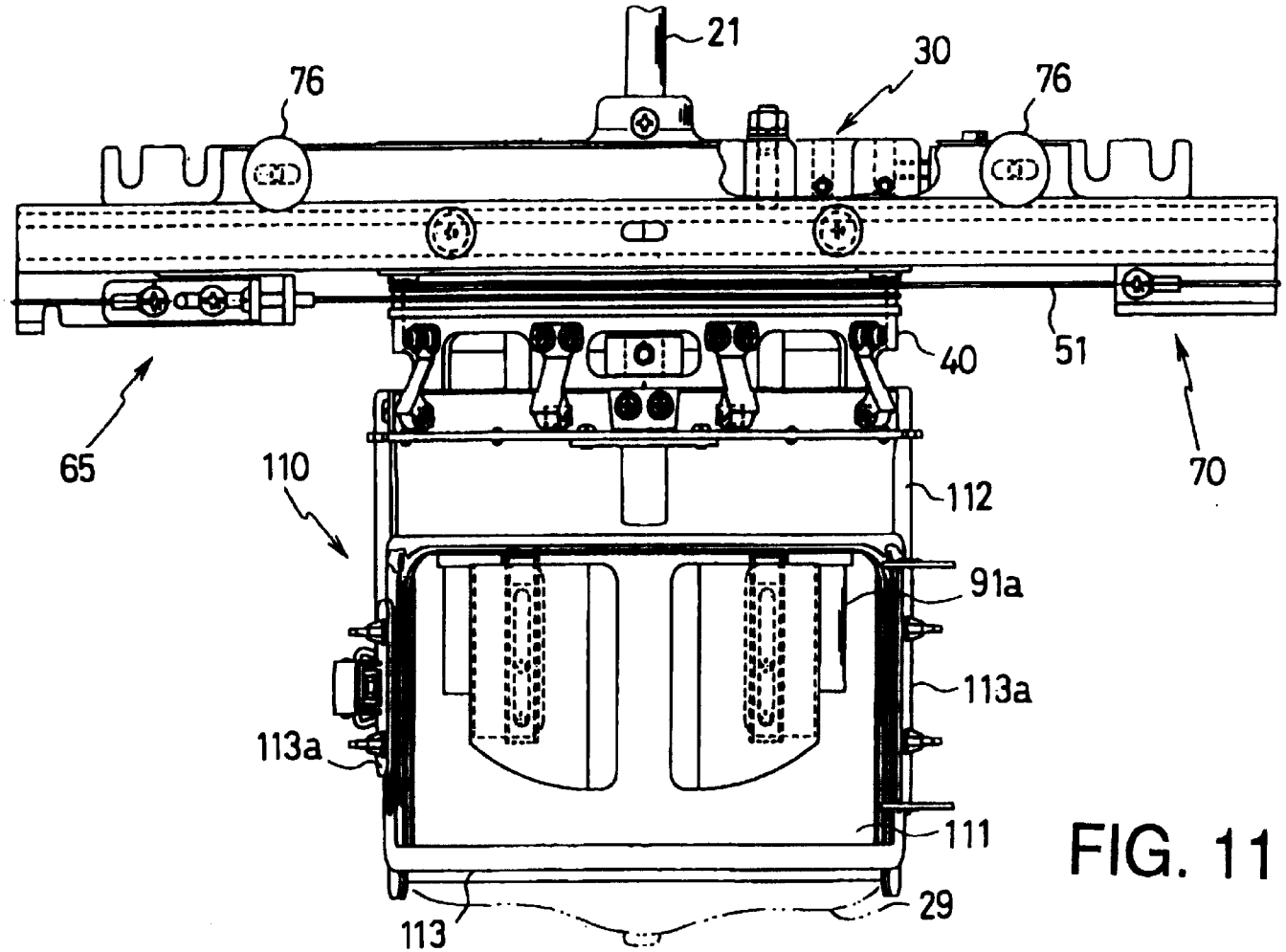
FIG. 11 is a view corresponding to FIG. 8, showing the headgear holding apparatus of FIG. 2, with the normal-range headgear holder being attached thereto.
Figure 12:
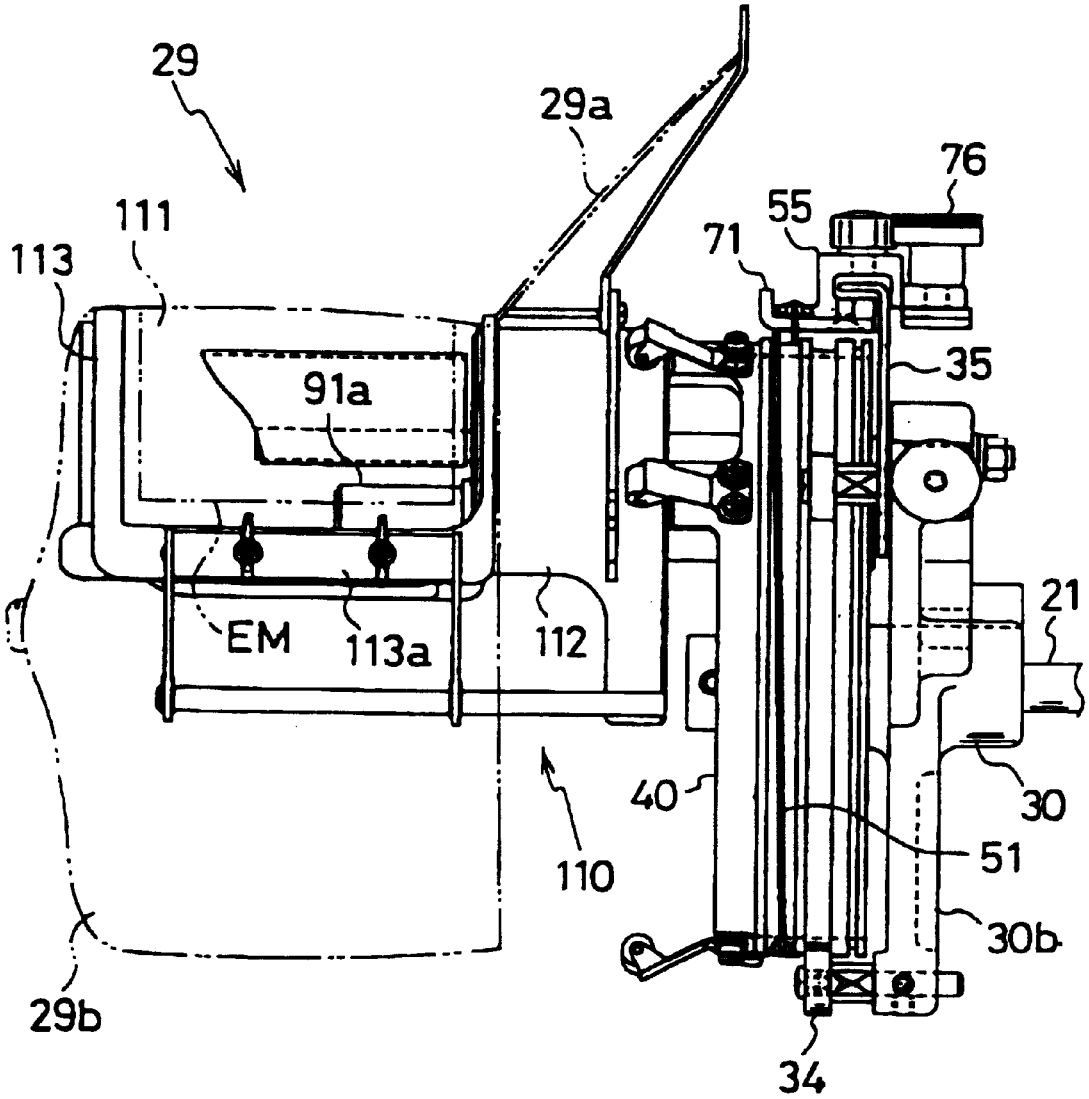
FIG. 12 is a view corresponding to FIG. 9, showing the headgear holding apparatus of FIG. 2, with the normal-range headgear holder being attached thereto.

Next, the normal-range headgear holder 110 which defines the normal-size, standard embroidery area EM will be described by reference to FIGS. 10, 11, and 12. The headgear holder 110 includes a main support member 112 which has a part-cylindrical shape having a radius of curvature corresponding to that of the headgear-holder support portion 42 of the rotatable structure 40 and which is detachably attached to the same 40. The main support member 112 has a generally rectangular central opening 111 corresponding to the standard embroidery area EM of the frontal portion of the cup portion 29*b* of the cap 29. The headgear holder 110 additionally includes a press member 113 which has a central opening corresponding to the opening 111 and which is pressed on the main support member 112 such that the respective openings of the two members 112, 113 are aligned with each other. More specifically described, after the cap 29 to be sewn is set on the main support member 112, opposite end portions 113*a* of the press member 113 are clamped to the main support member 112 using respective clamping devices. Thus, the headgear holder 110 holds the cap 29 such that the cloth of the standard embroidery area EM of the cap 29 is stretched out in the respective openings of the two members 112, 113.

The clamping devices for clamping the end portions 113*a* of the press member 113 include respective metal members. Though the guide portions 85*a* of the headgear support member 85 is positioned radially inward from the locus of rotation of the cap 29, the main support member 112 of the normal-range headgear holder 110 interferes with the headgear support member 85. Similarly, the main support member 112 interferes with the respective separable rollers 92 of the two guide rollers 90. Therefore, in the case where the normal-range headgear holder 110 is used with the rotatable structure 40, both of the two separable rollers 92 are separated from the corresponding base portions 91 of the guide rollers 90.

Since the respective end portions 91*a* of the base portions 91 from which the separable rollers 92 have been separated have a diameter smaller than that of the separable rollers 92, the main support member 112 cannot interfere with the end portions 91*a* of the guide rollers 90, when the normal-range headgear holder 110 is rotated.

The headgear support member 85 is easily detached from the vertical connection plate 35, and the separable rollers 92 are easily separated from the corresponding base portions 91. Accordingly, the normal-range headgear holder 110 is easily attached to the rotatable structure 40. The headgear support member 85 is easily attached to the connection plate 35 and the separable rollers 92 are easily joined to the corresponding base portions 91, when the normal-range headgear holder 110 is replaced by the wide-range headgear holder 100. When the worksheet feed frame 16 is moved in the X and Y directions, an excellent embroidery pattern is formed in the standard embroidery area EM of the cap 29 held by the normal-range headgear holder 110, as is done in the large embroidery area EL of the cap 29 held by the wide-range headgear holder 100.

As is apparent from the foregoing description, the present headgear holding apparatus 20 includes the base structure 30 which is provided, in the vicinity of each of the sewing-bed arms 6 of the multiple-head embroidery sewing machine SM, such that the base structure 30 is movable in the Y direction parallel to the each sewing-bed arm 6; the rotatable structure 40 which is supported by the base structure 30 such that the rotatable structure 40 is rotatable about an axis line parallel to the Y direction and to which the wide-range headgear holder 100 holding the cap 29 is detachably attached; the headgear support member 85 including the part-cylindrical guide portions 85*a*; and the pair of left-hand and right-hand guide rollers 90 which are attached to the base structure 30 such that the two guide rollers 90 are rotatable about respective axis lines parallel to the Y direction and such that the two guide rollers 90 contact the inner surface of the intermediate annular portion of the cup portion 29*b* of the cap 29 held by the headgear holder 100. Since the two guide rollers 90 cooperate with each other to keep stretching the cloth of the large embroidery area EL corresponding to the frontal and temporal portions of the cup portion 29*b* of the cap 29, thereby preventing wrinkles from occurring to the cloth, the cup portion 29*b* is rotated in substantial synchronism with the headgear holder 100.

Accordingly, the quality of the large embroidery pattern formed in the large area EL is improved.

Each of the two guide rollers 90 is held in frictional contact with the inner surface of the rotatable structure 40 via the rubber layer 95 which is provided on the rear end portion of the each roller 90 and which has a great friction factor. Therefore, when the rotatable structure 40 is rotated, the guide roller 90 is rotated because of the friction force produced between the rubber layer 95 and the inner surface of the structure 40. Thus, the guide rollers 90 actively rotate the entire cup portion 29*b* of the cap 29 because of the contact thereof with the inner surface of the cup portion 29*b*. Thus, the entire large embroidery area EL of the cup portion 29*b* is rotated while keeping its original generally part-annular or part-cylindrical shape.

When the cap 29 is rotated for being sewn by the sewing head M1–M3, the parietal portion 29*c* of the cup portion 29*b* of the cap 29 that is remote from the brim portion 29*a* tends to delay from the brim portion 29*a*. However, in the present apparatus 20, the two guide rollers 90 include the respective separable rollers 92 whose diameter is greater than that of the base portions 91, and the two separable rollers 92 have the respective rubber layers 95 which have a great friction factor. Accordingly, the frontal and temporal portions of the cup portion 29*b* that are adjacent to the parietal portion 29*c* are actively rotated by the separable rollers 92, while being supported by the headgear support member 85. That is, the entire cup portion 29*b* smoothly rotates without slipping on the rubber layers 95 of the separable rollers 92.

While the present invention has been described in its preferred embodiments, it is to be understood that the present invention may otherwise be embodied.

For example, although in the illustrated embodiments each of the two guide rollers 90 includes the rubber layer 95, it is possible that each guide roller be entirely formed of a material having a great friction factor, such as a member formed of a hard rubber, or a member formed of a synthetic resin or a hard rubber and having a file-like coarse surface.

While in the illustrated embodiments each of the two guide rollers 90 includes the straight pin 98, the coil spring 93, and the engageable holes 92*a*, it is possible that the separable roller 92 thereof have internal threads and the end portion 91*a* of the corresponding base portion 91 have external threads. In this case, the separable roller 92 can be screwed on and off the base portion 91.

Figure 13:
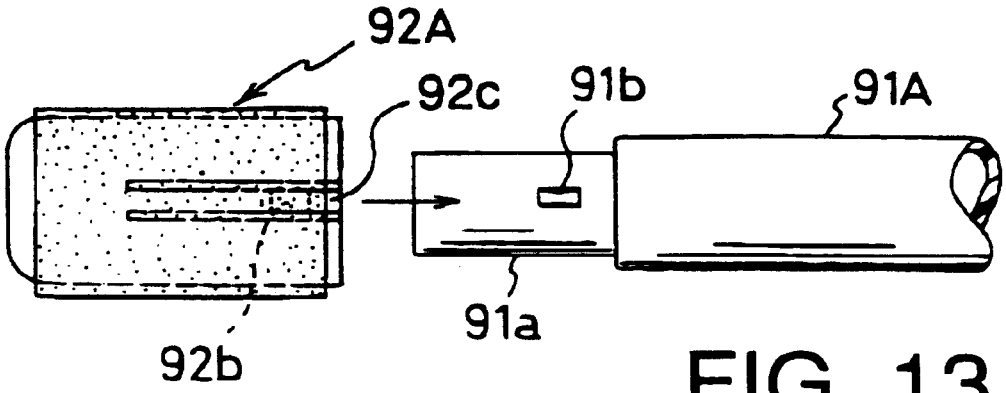
FIG. 13 is a side elevation view of a portion of another guide roller of another headgear holding apparatus as a second embodiment of the present invention.

In each of the illustrated embodiments, each of the guide rollers 90 may be replaced by a different guide roller, shown in FIG. 13, which includes a separable roller 92A and a base portion 91A. The base portion 91A has an engageable recess 91*b* formed in an end portion 91*a* thereof, and the separable roller 92A has an elastically deformable strip 92*c* which is defined by two parallel slits and which includes an engageable projection 92*b*. The projection 92*b* projects radially inward from the strip 92*c* and is engageable with the engageable recess 91*b*. In this case, the separable roller 92A is attached to, and detached from, the base portion 91A by the engagement and disengagement of the projection 92*b* with, and from, the recess 91*b*.

Figure 14:
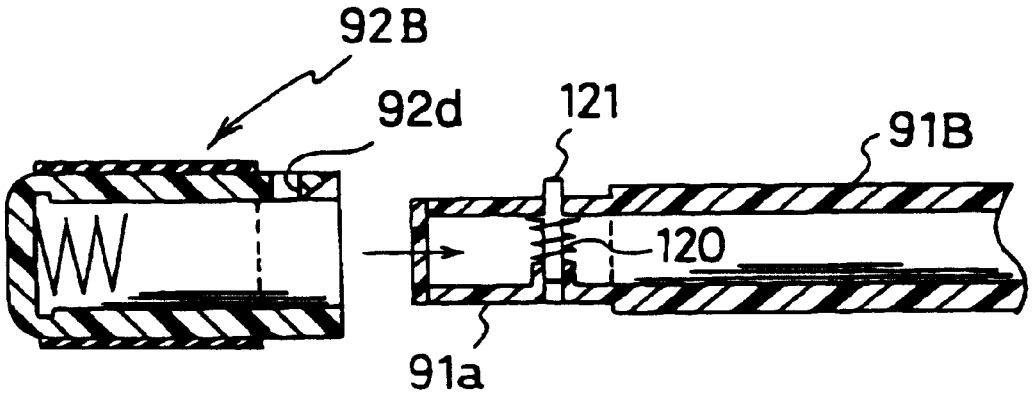
FIG. 14 is a view corresponding to FIG. 7, showing yet another guide roller of yet another headgear holding apparatus as a third embodiment of the present invention.

In each of the illustrated embodiments, each of the guide rollers 90 may be replaced by a different guide roller, shown in FIG. 14, which includes a separable roller 92B and a base portion 91B. The base portion 91B includes a movable pin 121 which is movably fitted in diametrically opposite holes of an end portion 91*a* thereof, and a coil spring 120 which is provided in an inner space of the end portion 91*a* and which biases the pin 121 toward its advanced position where the pin 121 partly projects radially outward from the end portion 91*a* and permits the pin 121 to be moved to its retracted position where the pin 121 is entirely retracted into the holes of the end portion 91*a*. The separable roller 92B has an engageable hole 92*d* and an inclined guide surface for guiding the pin 121. In this case, the separable roller 92B is attached to, and detached from, the base portion 91B by the engagement and disengagement of the pin 121 with, and from, the hole 92*d*.

It is to be understood that the present invention may be embodied with other changes, improvements, and modifications that may occur to those skilled in the art without departing from the spirit and scope of the invention defined in the appended claims.

What is claimed is:

1. A headgear holding apparatus for use with an embroidery sewing machine including a machine body having a sewing-bed arm, the apparatus comprising:

a base structure which is adapted to be attached to the machine body such that the base structure is movable in a first direction parallel to the sewing-bed arm;

a rotatable structure which is supported by the base structure such that the rotatable structure is rotatable about a first axis line parallel to the first direction;

a headgear holder which has a part-cylindrical outer surface for holding an inner surface of a headgear on which an embroidery is formed by the sewing machine, the headgear holder being detachably attached to the rotatable structure, such that the part-cylindrical outer surface of the headgear holder is rotated about the first axis line when the rotatable structure is rotated;

a headgear support member which is attached to the base structure, has a curved outer surface, and extends near a sewing position where a sewing needle of the sewing machine is reciprocated, the curved outer surface supporting the inner surface of the headgear held by the headgear holder when the headgear holder is rotated with the rotatable structure about the first axis line; and at least two guide rollers which are attached to the base structure such that the two guide rollers are provided on both sides of the headgear support member in a second direction perpendicular to the first direction, extend parallel to the first direction, and are rotatable about respective second axis lines parallel to the first axis line, the two guide rollers being located at respective positions where an outer circumferential surface of a contact portion of each of the two guide rollers contacts an inner surface of an intermediate annular portion of the headgear held by the headgear holder.

2. An apparatus according to claim 1, wherein the contact portion of said each guide roller has a diameter greater than a diameter of a main portion thereof.

3. An apparatus according to claim 1, wherein the contact portion of said each guide roller is separable from a main portion thereof.

4. An apparatus according to claim 2, wherein the contact portion of said each guide roller is separable from the main portion thereof.

5. An apparatus according to claim 4, wherein the headgear support member is detachable from the base structure.

6. An apparatus according to claim 4, wherein the headgear holder is selectable from (a) a first headgear holder which includes a main support member having said part-cylindrical outer surface, and a hold member cooperating with the main support member to hold an end annular portion of the headgear that is adjacent to an opening of the headgear through which a head of a user fits into the intermediate annular portion thereof, thereby providing a frontal portion and two temporal portions of the intermediate annular portion as an embroidery area on which the embroidery is formed by the sewing machine; and (b) a second headgear holder which includes a main support member having a first central opening and said part-cylindrical outer surface, and a hold member having a second central opening and cooperating with the main support member to hold a frontal portion of the intermediate annular portion of the headgear as an embroidery area in which the embroidery is formed by the sewing machine.

7. An apparatus according to claim 6, wherein the two guide rollers are located at said respective positions where when the first headgear holder is selected and attached to the rotatable structure, the outer circumferential surface of the contact portion of said each guide roller does not interfere with the main support member of the first headgear holder and where when the second headgear holder is selected and attached to the rotatable structure, the outer circumferential surface of the contact portion of said each guide roller interferes with the main support member of the second headgear holder and therefore the contact portion of said each guide roller is separated from the main portion thereof.

8. An apparatus according to claim 4, wherein the contact portion of said each guide roller comprises an outer layer formed of a material selected from the group consisting of a rubber and a resin.

9. An apparatus according to claim 4, wherein the contact portion of said each guide roller is substantially entirely formed of a material selected from the group consisting of a rubber and a resin.

10. An apparatus according to claim 1, wherein the contact portion of said each guide roller comprises an outer layer formed of a material selected from the group consisting of a rubber and a resin.

11. An apparatus according to claim 1, wherein the contact portion of said each guide roller is substantially entirely formed of a material selected from the group consisting of a rubber and a resin.

12. An apparatus according to claim 1, further comprising at least one drive device which rotates at least one of the two guide rollers to feed the headgear held by the headgear holder.

13. An apparatus according to claim 12, wherein each of the two guide rollers comprises, in addition to the contact portion thereof, a driven portion which is engaged with the rotatable structure, so that when the rotatable structure is rotated, said each guide roller is rotated to feed the headgear, said at least one drive device comprising the rotatable structure.

14. An apparatus according to claim 13, wherein an outer circumferential surface of the driven portion of said each guide roller is held in frictional contact with an inner circumferential surface of the rotatable structure, so that when the rotatable structure is rotated, the outer circumferential surface of the contact portion of said each guide roller is moved at a speed substantially equal to a speed at which the inner surface of the intermediate annular portion of the headgear is moved by the rotation of the headgear holder and the rotatable structure, in a same direction as a direction in which the inner surface of the intermediate annular portion is moved.

15. An apparatus according to claim 14, wherein said each guide roller comprises an outer layer which is formed of a material selected from the group consisting of a rubber and a resin, is provided on said driven portion, and is held in frictional contact with the inner circumferential surface of the rotatable structure.

16. A process of forming, using an embroidery sewing machine including a sewing needle and a sewing-bed arm in which a thread-loop catcher is provided, an embroidery on a headgear including an intermediate annular portion and having an opening through which a head of a user fits into the intermediate annular portion, the process comprising the steps of:

setting, on a headgear holder, the headgear such that an end annular portion of the headgear that is adjacent to the opening thereof is held by the headgear holder, positioning the headgear holder around the sewing-bed arm of the sewing machine, such that the headgear holder is rotatable around the sewing-bed arm, causing an outer circumferential surface of a contact portion of at least one feed roller to contact an inner surface of the intermediate annular portion of the headgear held by the headgear holder, rotating the headgear holder and thereby rotating the headgear relative to the sewing needle and the sewing-bed arm, so that the embroidery is formed, by cooperation of the sewing needle and the thread-loop catcher, on an outer surface of the intermediate annular portion of the headgear held by the headgear holder, and rotating the at least one feed roller such that the outer circumferential surface thereof is moved at a speed substantially equal to a speed at which the inner surface of the intermediate annular portion of the headgear is moved by the rotation of the headgear holder, in a same direction as a direction in which the inner surface of the intermediate annular portion is moved.

17. A process according to claim 16, wherein said at least one feed roller is rotated in substantial synchronism with the rotation of the headgear holder.

18. A process according to claim 16, wherein the headgear is fed by at least two feed rollers which are provided on both sides of the sewing-bed arm of the sewing machine.

* * * * *

UNITED STATES PATENT AND TRADEMARK OFFICE

CERTIFICATE OF CORRECTION

PATENT NO. : 6,119,609

DATED : September 19, 2000

INVENTOR(S) : Yasuhiko KAWAGUCHI and Akio TAKAHASHI

It is certified that error appears in the above-identified patent and that said Letters Patent is hereby corrected as shown below:

Please add:

[30] Foreign Application Priority Data

July 8, 1997 [JP] Japan.....9-199228
July 8, 1997 [JP] Japan.....9-199229

Signed and Sealed this

First Day of May, 2001

*Attest:*

Nicholas P. Godici

NICHOLAS P. GODICI

*Attesting Officer*

*Acting Director of the United States Patent and Trademark Office*